United States Patent [19]

Buss

[11] Patent Number: 4,645,586

[45] **Date of Patent: * Feb. 24, 1987**

[54] REFORMING PROCESS

[75] Inventor: Waldeen C. Buss, Kensington, Calif.

[73] Assignee: Chevron Research Company, San Francisco, Calif.

[ * ] Notice: The portion of the term of this patent subsequent to Jan. 13, 2004 has been disclaimed.

[21] Appl. No.: 679,163

[22] Filed: Dec. 7, 1984

Related U.S. Application Data

[63] Continuation of Ser. No. 513,536, Jun. 3, 1983, abandoned.

[51] Int. Cl.[4] ..... C10G 35/06

[52] U.S. Cl. ..... 208/65; 208/64; 208/79; 208/80

[58] Field of Search ..... 208/64, 65, 79, 80

[56] References Cited

U.S. PATENT DOCUMENTS

| | | | |
|---|---|---|---|
| 3,397,137 | 8/1968 | Pickert et al. | 208/138 |
| 3,658,691 | 4/1972 | Keith et al. | 208/65 |
| 3,783,123 | 1/1974 | Young | 208/111 |
| 4,104,320 | 8/1978 | Bernard et al. | 208/141 |
| 4,401,557 | 8/1983 | Juquin et al. | 208/139 |

*Primary Examiner*—Curtis R. Davis

*Attorney, Agent, or Firm*—S. R. LaPaglia; E. A. Schaal; P. L. McGarrigle, Jr.

[57] ABSTRACT

A reforming process is disclosed wherein a hydrocarbon feed is contacted with two reforming catalysts at conditions which favor reforming. The first reforming catalyst comprises a metallic oxide support having disposed therein a Group VIII metal. This first reforming catalyst may contain Group VIII metal promoters, such as rhenium, tin, germanium, cobalt, nickel, iridium, rhodium, ruthenium and combinations thereof. The second reforming catalyst is a non-acidic catalyst comprising a large-pore zeolite containing at least one Group VIII metal. A preferred first reforming catalyst comprises alumina having disposed therein in intimate admixture platinum and rhenium. A preferred second reforming catalyst is a non-acidic catalyst comprising a type L zeolite containing platinum.

21 Claims, No Drawings

REFORMING PROCESS

This application is a continuation of U.S. application Ser. No. 513,536, filed June 3, 1983, now abandoned.

BACKGROUND OF THE INVENTION

The invention relates to a new hydrocarbon conversion process wherein hydrocarbons are contacted with both a conventional reforming catalyst and a zeolitic catalyst which has a superior selectivity for dehydrocyclization.

Catalytic reforming is well known in the petroleum industry and refers to the treatment of naphtha fractions to improve the octane rating and/or to produce aromatic hydrocarbons for use as chemical feedstock. The more important hydrocarbon reactions occurring during reforming operation include dehydrogenation of cyclohexanes and dehydroisomerization of alkylcyclopentanes to aromatics, dehydrocyclization of paraffins to aromatics, isomerization of normal paraffins to isoparaffins, dealkylation of alkylbenzenes, and hydrocracking. Hydrocracking reactions which produce light gaseous hydrocarbons, e.g., methane, ethane, propane and butane are to be minimized during reforming as this decreases the yield of gasoline boiling products.

Catalysts comprising platinum, for example, platinum supported on alumina, are well known and widely used for reforming of naphthas and gasoline boiling range materials in order to produce high octane number gasolines.

A particularly advantageous method of reforming is in the presence of hydrogen with a catalyst composition of a porous solid catalyst support, such as alumina, and 0.1 to 3 percent platinum and 0.01 to 5 weight percent rhenium. Other bimetallic catalysts reported to be advantageous include platinum-tin, platinum-germanium, platinum-lead, and platinum-iridium.

The possibility of using carriers other than alumina has also been studied and it was proposed to use certain molecular sieves such as X and Y zeolites, because the pore sizes of the zeolites were large enough to pass the reactant and product molecules through the pores of the zeolite. However, catalysts based upon these molecular sieves have not been commercially successful.

In the conventional method of carrying out the aforementioned dehydrocyclization, hydrocarbons to be converted are passed over the catalyst, in the presence of hydrogen, at temperatures of 430° C. to 550° C. and pressures of 100 to 500 psig. Part of the hydrocarbons are converted into aromatic hydrocarbons, and the reaction is accompanied by isomerization and cracking reactions which also convert the paraffins into isoparaffins and lighter hydrocarbons.

The rate of conversion of the nonaromatic hydrocarbons into aromatic hydrocarbons varies with the reaction conditions and the nature of the catalyst.

The catalysts hitherto used have given moderately satisfactory results with heavy paraffins, but less satisfactory results with $C_6$–$C_8$ paraffins, particularly $C_6$ paraffins. Catalysts based on a type L zeolite are more selective with regard to the dehydrocyclization reaction; can be used to improve the rate of conversion to aromatic hydrocarbons without requiring higher temperatures and lower pressures, which usually have a considerable adverse effect on the stability of the catalyst; and produce excellent results with $C_6$–$C_8$ paraffins, but run length is a problem.

In one method of dehydrocyclizing aliphatic hydrocarbons, hydrocarbons are contacted in the presence of hydrogen at a temperature of 430° C. to 550° with a catalyst consisting essentially of a type L zeolite having exchangeable cations of which at least 90% are alkali metal ions selected from the group consisting of ions of sodium, lithium, potassium, rubidium and cesium and containing at least one metal selected from the group which consists of metals of Group VIII of the Periodic Table of Elements, tin and germanium, said metal or metals including at least one metal from Group VIII of said Periodic Table having a dehydrogenating effect, so as to convert at least part of the feedstock into aromatic hydrocarbons.

A particularly advantageous embodiment of this method is a platinum/alkali metal/type L zeolite catalyst because of its excellent activity and selectivity for converting hexanes and heptanes to aromatics, but run length remains a problem.

SUMMARY OF THE INVENTION

The present invention overcomes the deficiencies of the prior art by using, in combination, a first, conventional reforming catalyst comprising a metallic oxide support having disposed therein a Group VIII metal, and a second, non-acidic reforming catalyst comprising a large-pore zeolite containing at least one Group VIII metal to reform hydrocarbons at an extremely high selectivity for converting alkanes to aromatics. The first reforming catalyst may contain Group VIII metal promoters, such as rhenium, tin, germanium, cobalt, nickel, iridium, rhodium, ruthenium and combinations thereof.

Preferably, the first reforming catalyst comprises alumina having disposed therein in intimate admixture platinum and rhenium. The preferred second reforming catalyst is a non-acidic catalyst comprising a type L zeolite containing platinum.

DESCRIPTION OF THE PREFERRED EMBODIMENTS

In its broadest aspect, the present invention involves the use of a first catalyst which is a conventional reforming catalyst and a second catalyst which is a dehydrocyclization zeolitic catalyst comprising a large-pore zeolite and a Group VIII metal in the reforming of hydrocarbons.

The term "selectivity" as used in the present invention is defined as the percentage of moles of paraffin converted to aromatics relative to moles converted to aromatics and cracked products, $$\text{i.e., Selectivity} = \frac{100 \times \text{moles of paraffins converted to aromatics}}{\text{moles of paraffins converted to aromatics and cracked products}}$$

Isomerization reactions and formation of alkylcyclopentanes are not considered in determining selectivity.

The term "selectivity for n-hexane" as used in the present invention is defined as the percentage of moles of n-hexane converted to aromatics relative to moles converted to aromatics and cracked products.

The selectivity for converting paraffins to aromatics is a measure of the efficiency of the process in converting paraffins to the desired and valuable products: aromatics and hydrogen, as opposed to the less desirable products of hydrocracking.

Highly selective dehydrocyclization catalysts produce more hydrogen than less selective catalysts because hydrogen is produced when paraffins are converted to aromatics and hydrogen is consumed when paraffins are converted to cracked products. Increasing the selectivity of the process increases the amount of hydrogen produced (more aromatization) and decreases the amount of hydrogen consumed (less cracking).

Another advantage of using highly selective dehydrocyclization catalysts is that the hydrogen produced by highly selective catalysts is purer than that produced by less selective catalysts. This higher purity results because more hydrogen is produced, while less low boiling hydrocarbons (cracked products) are produced. The purity of hydrogen produced in reforming is critical if, as is usually the case in an integrated refinery, the hydrogen produced is utilized in processes such as hydrotreating and hydrocracking, which require at least certain minimum partial pressures of hydrogen. If the purity becomes too low, the hydrogen can no longer be used for this purpose and must be used in a less valuable way, for example as fuel gas.

In the method according to the invention, the feed hydrocarbons preferably comprise nonaromatic hydrocarbons containing at least 6 carbon atoms. Preferably, the feedstock is substantially free of sulfur, nitrogen, metals and other known poisons for reforming catalysts.

The first reforming catalyst comprises a metallic oxide support having disposed therein a Group VIII metal. Suitable metallic oxide supports include alumina and silica. Preferably, the first reforming catalyst comprises a metallic oxide support having disposed therein in intimate admixture a Group VIII metal (preferably platinum) and a Group VIII metal promoter, such as rhenium, tin, germanium, cobalt, nickel, iridium, rhodium, ruthenium and combinations thereof. More preferably, the first reforming catalyst comprises an alumina support, platinum, and rhenium. Preferably, the catalyst is not presulfided, since the second catayst is extremely sensitive to sulfur poisoning. If the first catalyst requires presulfiding, then something should be done to prevent sulfur poisoning of the second catalyst. Possible options include: (1) using a sulfur sorber or getter between the first and second catalysts; (2) presulfiding the first catalyst externally, and stripping the removable sulfur with hydrogen; and (3) presulfiding the first catalyst with a minimum amount of sulfur which is retained by the first catalyst.

The hydrocarbon conversion process with both catalysts is carried out in the presence of hydrogen at a pressure adjusted so as to favor the dehydrocyclization reaction thermodynamically and to limit undesirable hydrocracking reactions. The pressures used preferably vary from 1 atmosphere to 500 psig, more preferably from 50 to 300 psig, the molar ratio of hydrogen to hydrocarbons preferably being from 1:1 to 10:1, more preferably from 2:1 to 6:1.

In the temperature range of from 400° C. to 600° C., the dehydrocyclization reaction occurs with acceptable speed and selectivity.

If the operating temperature of dehydrocyclization is below 400° C., the reaction speed is insufficient and consequently the yield is too low for industrial purposes. When the operating temperature of dehydrocyclization is above 600° C., interfering secondary reactions such as hydrocracking and coking occur, and substantially reduce the yield. It is not advisable, therefore, to exceed the temperature of 600° C.

The preferred temperature range (430° C. to 550° C.) of dehydrocyclization is that in which the process is optimum with regard to activity, selectivity and the stability of the catalyst.

The liquid hourly space velocity of the hydrocarbons in the dehydrocyclization reaction is preferably between 0.3 and 5.

The second catalyst according to the invention is a large-pore zeolite charged with one or more dehydrogenating constituents. The term "large-pore zeolite" is defined as a zeolite having an effective pore diameter of 6 to 15 Angstroms.

Among the large-pored crystalline zeolites which have been found to be useful in the practice of the present invention, type L zeolite, zeolite X, zeolite Y and faujasite are the most important and have apparent pore sizes on the order of 7 to 9 Angstroms.

A composition of type L zeolite, expressed in terms of mole ratios of oxides, may be represented as follows:

$$(0.9\text{–}1.3)M_{2/n}O:Al_2O_3(5.2\text{–}6.9)SiO_2:yH_2O$$

wherein M designates a cation, n represents the valence of M, and y may be any value from 0 to about 9. Zeolite L, its X-ray diffraction pattern, its properties, and method for its preparation are described in detail in U.S. Pat. No. 3,216,789. U.S. Pat. No. 3,216,789 is hereby incorporated by reference to show the preferred zeolite of the present invention. The real formula may vary without changing the crystalline structure; for example, the mole ratio of silicon to aluminum (Si/Al) may vary from 1.0 to 3.5.

The chemical formula for zeolite Y expressed in terms of mole ratios of oxides may be written as:

$$(0.7\text{–}1.1)Na_2O:Al_2O_3:xSiO_2:yH_2O$$

wherein x is a value greater than 3 up to about 6 and y may be a value up to about 9. Zeolite Y has a characteristic X-ray powder diffraction pattern which may be employed with the above formula for identification. Zeolite Y is described in more detail in U.S. Pat. No. 3,130,007. U.S. Pat. No. 3,130,007 is hereby incorporated by reference to show a zeolite useful in the present invention.

Zeolite X is a synthetic crystalline zeolitic molecular sieve which may be represented by the formula:

$$(0.7\text{–}1.1)M_{2/n}O:Al_2O_3:(2.0\text{–}3.0)SiO_2:yH_2O$$

wherein M represents a metal, particularly alkali and alkaline earth metals, n is the valence of M, and y may have any value up to about 8 depending on the identity of M and the degree of hydration of the crystalline zeolite. Zeolite X, its X-ray diffraction pattern, its properties, and method for its preparation are described in detail in U.S. Pat. No. 2,882,244. U.S. Pat. No. 2,882,244 is hereby incorporated by reference to show a zeolite useful in the present invention.

The preferred dehydrocyclization catalyst according to the invention is a type L zeolite charged with one or more dehydrogenating constituents.

The large-pore zeolitic dehydrocyclization catalysts according to the invention are charged with one or more Group VIII metals, e.g., nickel, ruthenium, rhodium, palladium, iridium or platinum.

The preferred Group VIII metals are iridium and particularly platinum, which are more selective with regard to dehydrocyclization and are also more stable under the dehydrocyclization reaction conditions than other Group VIII metals.

The preferred percentage of platinum in the dehydrocyclization catalyst is between 0.1% and 5%, the lower limit corresponding to minimum catalyst activity and the upper limit to maximum activity. This allows for the high price of platinum, which does not justify using a higher quantity of the metal since the result is only a slight improvement in catalyst activity.

Group VIII metals are introduced into the large-pore zeolite by synthesis, impregnation or exchange in an aqueous solution of appropriate salt. When it is desired to introduce two Group VIII metals into the zeolite, the operation may be carried out simultaneously or sequentially.

By way of example, platinum can be introduced by impregnating the zeolite with an aqueous solution of tetrammineplatinum (II) nitrate, tetrammineplatinum (II) hydroxide, dinitrodiamino-platinum or tetrammineplatinum (II) chloride. In an ion exchange process, platinum can be introduced by using cationic platinum complexes such as tetrammineplatinum (II) nitrate.

An inorganic oxide may be used as a carrier to bind the large-pore zeolite containing the Group VIII metal. The carrier can be a natural or a synthetically produced inorganic oxide or combination of inorganic oxides. Typical inorganic oxide supports which can be used include clays, alumina, and silica, in which acidic sites are preferably exchanged by cations which do not impart strong acidity.

The large-pore zeolitic dehydrocyclization catalyst can be employed in any of the conventional types of equipment known to the art. It may be employed in the form of pills, pellets, granules, broken fragments, or various special shapes, disposed as a fixed bed within a reaction zone, and the charging stock may be passed therethrough in the liquid, vapor, or mixed phase, and in either upward or downward flow. Alternatively, it may be prepared in a suitable form for use in moving beds, or in fluidized-solid processes, in which the charging stock is passed upward through a turbulent bed of finely divided catalyst.

After the desired metal or metals have been introduced, the dehydrocyclization catalyst is treated in air at from 250° to 350° C. and then reduced in hydrogen at temperatures of from 200° C. to 700° C., preferably 300° C. to 620° C.

At this stage it is ready for use in the dehydrocyclization process. In some cases however, for example when the metal or metals have been introduced by an ion exchange process, it is preferable to eliminate any residual acidity of the zeolite by treating the reduced catalyst with an aqueous solution of a salt of a suitable alkali or alkaline earth element in order to neutralize any hydrogen ions formed during the reduction of metal ions by hydrogen.

In order to obtain optimum selectivity, temperature should be adjusted so that dehydrocyclization reaction rate is appreciable, but conversion is less than 98%, as excessive temperature and excess reaction can have an adverse effect on selectivity. Pressure should also be adjusted within a proper range. Too high a pressure will place a thermodynamic (equilibrium) limit on the desired reaction, especially for hexane aromatization, and too low a pressure may result in coking and deactivation.

Although the primary benefit of this invention is in improving the selectivity for conversion of paraffins (especially $C_6$–$C_8$ paraffins) to aromatics, it is also surprisingly found that the selectivity for conversion of methylcyclopentane to aromatics is excellent. This reaction, which on conventional reforming catalysts based on chlorided alumina involves an acid catalyzed isomerization step, occurs on the catalyst of this invention with selectivity as good as or better than on the chlorided alumina based catalysts of the prior art. Thus, the present invention can also be used to catalyze the conversion of stocks high in 5-membered-ring naphthenes to aromatics.

Another advantage of this invention is that the dehydrocyclization catalyst of the present invention is more stable than prior art zeolitic catalysts. Stability of the catalyst, or resistance to deactivation, determines its useful run length. Longer run lengths result in less down time and expense in regenerating or replacing the catalyst charge.

The hydrocarbons can be contacted with the two catalysts in series, with the hydrocarbons first being contacted with the first (conventional) reforming catalyst, and then with the second (dehydrocyclization zeolitic) catalyst; or with the hydrocarbons first being contacted with the second catalyst, and then with the first catalyst. Also the hydrocarbons can be contacted in parallel with one fraction of the hydrocarbons being contacted with the first catalyst and another fraction of the hydrocarbons being contacted with the second catalyst. Also the hydrocarbons can be contacted with both catalysts simultaneously in the same reactor.

While the present invention has been described with reference to specific embodiments, this application is intended to cover those various changes and substitutions which may be made by those skilled in the art without departing from the spirit and scope of the appended claims.

What is claimed is:

1. A reforming process comprising:

(a) contacting a hydrocarbon feed with a first reforming catalyst at conditions which favor reforming to form a product stream, wherein said first reforming catalyst is bifunctional and comprises a metallic oxide support which contains acidic sites having disposed therein a Group VIII metal; and (b) contacting said product stream with a second reforming catalyst at conditions which favor reforming, wherein said second reforming catalyst is a monofunctional, non-acidic catalyst comprising a large-pore zeolite containing at least one Group VIII metal.

2. A reforming process according to claim 1 wherein said first reforming catalyst contains a Group VIII metal promoter selected from the group consisting of rhenium, tin, germanium, cobalt, nickel, iridum, rhodium, ruthenium and combinations thereof.

3. A reforming process according to claim 2 wherein said Group VIII metal in said first reforming catalyst is platinum.

4. A reforming process according to claim 3 wherein said metallic oxide support is alumina.

5. A reforming process according to claim 4 wherein said Group VIII metal promoter is rhenium.

6. A reforming process according to claim 1 wherein said large-pore zeolite is a type L zeolite.

7. A reforming process according to claim 6 wherein said Group VIII metal in said second reforming catalyst is platinum.

8. A reforming process comprising:

(a) contacting a hydrocarbon feed with a first reforming catalyst at conditions which favor reforming to form a product stream, wherein said first reforming catalyst is bifunctional and comprises a metallic oxide support which contains acidic sites having disposed therein in intimate admixture platinum and a platinum promoter, and wherein said platinum promoter is selected from the group consisting of rhenium, tin, germanium, cobalt, nickel, iridium, rhodium, ruthenium and combinations thereof; and (b) contacting said product stream with a second reforming catalyst at conditions which favor reforming, wherein said second reforming catalyst is a monofunctional, non-acidic catalyst comprising a type L zeolite containing platinum.

9. A reforming process according to claim 8 wherein said second reforming catalyst is air-calcined prior to use as a catalyst.

10. A reforming process according to claim 9 wherein said hydrocarbon feed comprises $C_6+$ naphthas.

11. A reforming process comprising:

(a) contacting a hydrocarbon feed comprising $C_6+$ naphthas with a first reforming catalyst at conditions which favor reforming to form a product stream, wherein said first reforming catalyst is bifunctional and comprises alumina which has acidic sites having disposed therein in intimate admixture platinum and rhenium; and (b) contacting said product stream with a second reforming catalyst at conditions which favor reforming, wherein said second reforming catalyst is a monofunctional, non-acidic catalyst comprising a type L zeolite containing platinum, wherein said second reforming catalyst is air-calcined prior to use as a catalyst.

12. A reforming process comprising:

(a) contacting a hydrocarbon feed with a first reforming catalyst at conditions which favor reforming to form a product stream, wherein said first reforming catalyst is bifunctional and comprises a metallic oxide support which has acidic sites having disposed therein a Group VIII metal; and (b) contacting in a parallel step said hydrocarbon feed with a second reforming catalyst at conditions which favor reforming, wherein said second reforming catalyst is a monofunctional, non-acidic catalyst comprising a large-pore zeolite containing at least one Group VIII metal.

13. A reforming process according to claim 12 wherein said first reforming catalyst contains a Group VIII metal promoter selected from the group consisting of rhenium, tin, germanium, colbalt, nickel, iridum, rhodium, ruthenium and combinations thereof.

14. A reforming process according to claim 13 wherein said Group VIII metal in said first reforming catalyst is platinum.

15. A reforming process according to claim 14 wherein said metallic oxide support is alumina.

16. A reforming process according to claim 15 wherein said Group VIII metal promoter is rhenium.

17. A reforming process according to claim 12 wherein said large-pore zeolite is a type L zeolite.

18. A reforming process according to claim 17 wherein said Group VIII metal in said second reforming catalyst is platinum.

19. A reforming process comprising:

(a) contacting a hydrocarbon feed with a first reforming catalyst at conditions which favor reforming to form a product stream, wherein said first reforming catalyst is bifunctional and comprises a metallic oxide support which has acidic sites having disposed therein in intimate admixture platinum and a platinum promoter, and wherein said platinum promoter is selected from the group consisting of rhenium, tin, germanium, cobalt, nickel, iridium, rhodium, ruthenium and combinations thereof; and (b) contacting in a parellel step said hydrocarbon feed with a second reforming catalyst at conditions which favor reforming, wherein said second reforming catalyst is a monofunctional, non-acidic catalyst comprising a type L zeolite containing platinum.

20. A reforming process according to claim 19 wherein said second reforming catalyst is air-calcined prior to use as a catalyst.

21. A reforming process according to claim 20 wherein said hydrocarbon feed comprises $C_6+$ naphthas.

* * * * *